US007090026B2

(12) United States Patent
Domann et al.

(10) Patent No.: US 7,090,026 B2
(45) Date of Patent: Aug. 15, 2006

(54) APPARATUS AND METHOD FOR INJECTING TUBING IN A WELL BORE

(75) Inventors: Robert E. Domann, Duncan, OK (US); Randy S. Rosine, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 176 days.

(21) Appl. No.: 10/840,786

(22) Filed: May 6, 2004

(65) Prior Publication Data

US 2005/0247454 A1 Nov. 10, 2005

(51) Int. Cl.
*E21B 19/22* (2006.01)

(52) U.S. Cl. ..... 166/384; 166/77.3

(58) Field of Classification Search ..... 166/380, 166/384, 85.1, 85.5, 77.1–77.4
See application file for complete search history.

(56) References Cited

U.S. PATENT DOCUMENTS 3,841,407 A * 10/1974 Bozeman ..... 166/384
5,309,990 A * 5/1994 Lance ..... 166/77.3
6,173,769 B1 1/2001 Goode ..... 166/77.3
6,216,780 B1 4/2001 Goode et al. ..... 166/77.3
6,367,557 B1 4/2002 Rosine et al. ..... 166/384
6,892,810 B1 * 5/2005 Austbo et al. ..... 166/85.5
2003/0209346 A1 11/2003 Austbo et al. ..... 166/77.2

OTHER PUBLICATIONS

Patent Application entitled "Hydraulic Circuit And Method For Operating A Gripping Device" by Robert E. Domann, filed concurrently herewith.

* cited by examiner

*Primary Examiner*—David Bagnell
*Assistant Examiner*—Matthew J. Smith
(74) *Attorney, Agent, or Firm*—John W. Wustenberg; Haynes & Boone, L.L.P.

(57) ABSTRACT

An apparatus and method for moving a tubing along a path, according to which the tubing is engaged by an outer chain which is driven to advance the tubing. The chain is adapted to be deflected radially in response to an increase in the diameter of the tubing, and a plate is compressed in response to the deflection of the chain to accommodate the variation in diameter.

19 Claims, 4 Drawing Sheets

APPARATUS AND METHOD FOR INJECTING TUBING IN A WELL BORE

BACKGROUND

The present invention relates to an injector for injecting coiled tubing into an oil or gas well.

Coiled tubing injectors are often used to inject coiled tubing into an oil or gas well to facilitate the servicing of the well. For some well-servicing applications, the diameter of the tubing must be increased in the upper sections of the tubing for reasons related to the well-servicing process.

One technique for accommodating an increase in diameter is to dispose a tapered connector between a relative small-diameter section and a relatively large diameter section. However, a problem arises in connection with this technique especially when the tubing passes through an injector for injecting it into the well. In particular, due to the rigidity of the injector structure, substantially all of the loading on the tubing provided by the injector is applied to the area of the connector having the relatively larger diameter. This results in a relatively small percentage of the exterior surface of the connector bearing substantially all of the loading, creating high stress areas at the points of contact with the injector, and possibly causing failure in the connector and/or the tubing.

Therefore, what is needed is an injector for passing coiled tubing through an injector that overcomes this problem.

DETAILED DESCRIPTION

Figure 1:
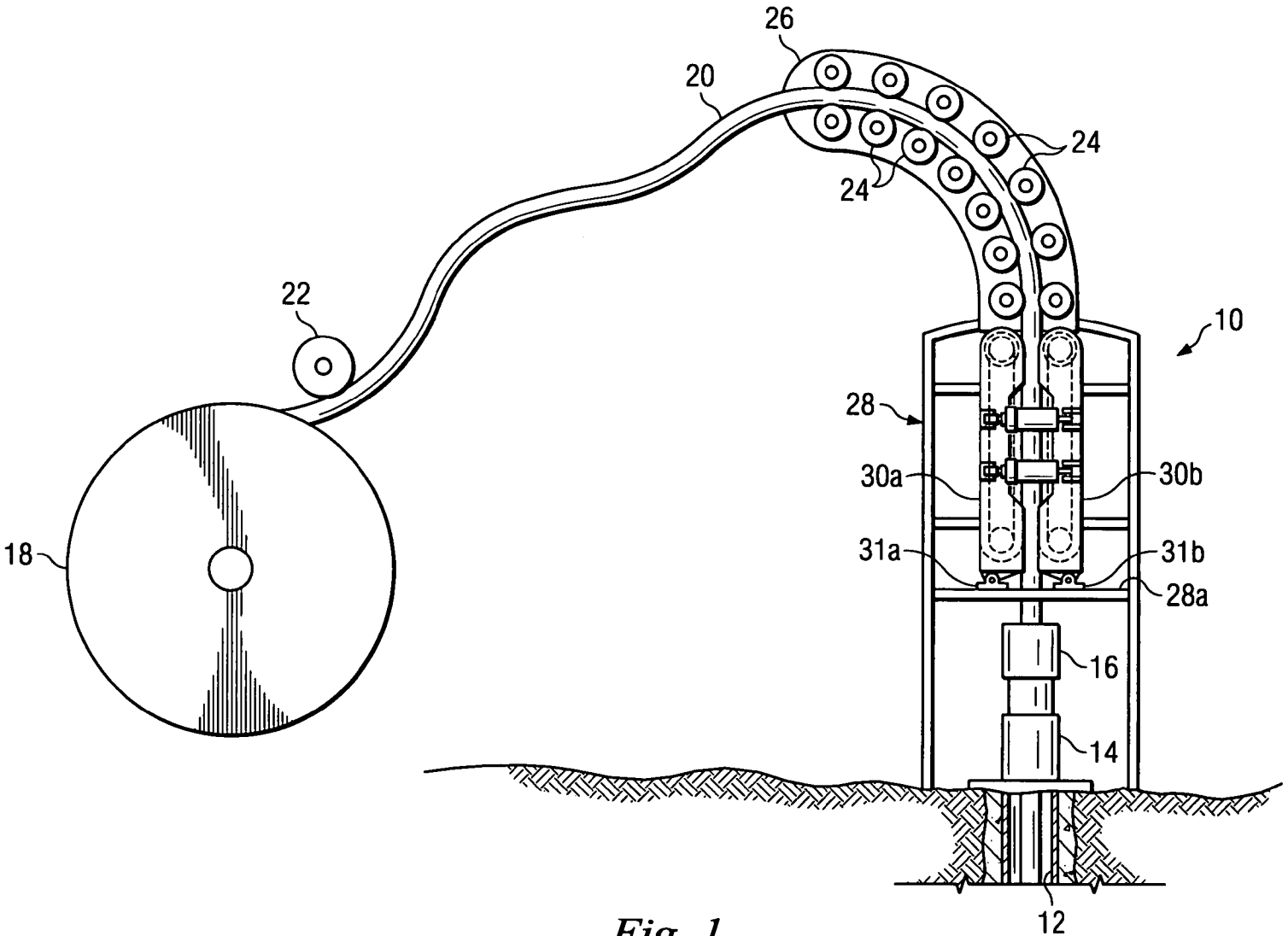
FIG. 1 is a partial elevational/partial sectional view, not necessarily to scale, depicting a coiled tubing injector according to an embodiment of the invention.

Referring to FIG. 1, the reference numeral 10 refers, in general, to a coiled tubing injector 10 positioned directly above a well 12. A well-head 14 extends above the well, and a lubricator, or stuffing box 16 extends above the well-head.

A spool of coiled tubing 18 is positioned at a predetermined location away from the injector 10. Unspooled tubing 20 passes from the spool and under a measuring device, such as a wheel 22, and between several (seven in the example of FIG. 1) pairs of opposed rollers 24 rotatably mounted to an arcuate support platform 26. The tubing 20 then passes from the last pair of rollers into the injector 10.

The injector 10 includes a frame 28 having a base 28*a*, and a pair of substantially similar carriages 30*a* and 30*b* mounted on the base via a pair of carrier lugs 31*a* and 31*b*. The carriages 30*a* and 30*b* drive the tubing 20 into the stuffing box 16 for passage through the well-head 14 and into the well 12.

Figure 2:
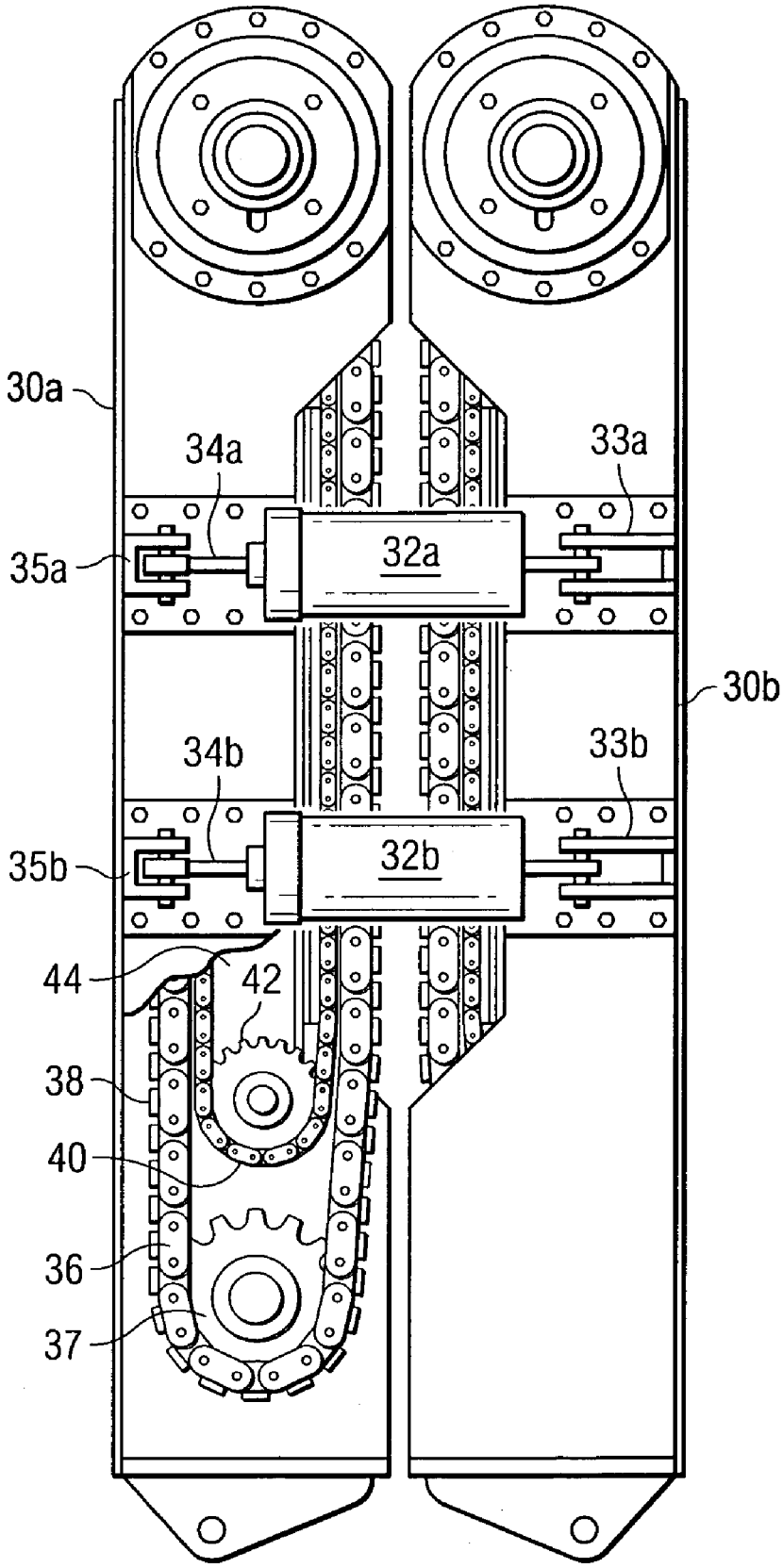
FIG. 2 is an enlarged view of a portion of the injector of FIG. 1.

The carriages 30*a* and 30*b* are depicted in greater detail in FIG. 2, with the remaining structure of the injector 10 and the tubing 20 being removed from view in the interest of clarity. Two hydraulic actuated cylinders 32*a* and 32*b* extend between the carriages 30*a* and 30*b* and are connected to the carriages in any conventional manner. The cylinders 32*a* and 32*b* are connected to the carriage 30*b* by two mounting brackets 33*a* and 33*b*, respectively, and each cylinder 32*a* and 32*b* includes a piston (not shown) that reciprocates in a cylinder housing in response to hydraulic fluid being introduced into, and discharged from, the housing, in a conventional manner.

Two rods 34*a* and 34*b* extend out from the cylinders 32*a* and 32*b*, respectively, with one end of each rod being connected to its corresponding piston and the other end connected to the carriage 30*a* by two mounting brackets 35*a* and 35*b*, respectively. It is understood that the cylinders 32*a* and 32*b* are connected in a hydraulic circuit (not shown) so that fluid is selectively introduced and discharged from the cylinders to cause corresponding contraction and extension of the cylinders. An example of the hydraulic circuit that may be used is disclosed in co-pending patent application Ser. No. 10/840,787 the disclosure of which is incorporated herein by reference in its entirety. This contraction and extension of the cylinders 32*a* and 32*b* causes corresponding movement of the carriages 30*a* and 30*b* towards each other to grip the tubing 20, and away from each other to release the tubing. It is understood that two other cylinders (not shown), identical to the cylinders 32*a* and 32*b*, are connected to the carriages 30*a* and 30*b* on the other sides of the carriages.

The carriage 30*a* includes a gripping chain 36 extending between, and engaged with, two spaced sprockets 37 (one of which is shown in FIG. 2). A plurality of gripping elements 38 are mounted to the outer surface of the chain 36 and are adapted to engage and grip the tubing 20 in a conventional manner. A roller chain 40 is also provided that extends within the gripping chain 36 and engages two spaced sprockets 42 (one of which is shown in FIG. 2). Both the roller chain 40 and the gripping chain 36 are disposed around a linear beam 44, shown partially in FIG. 2, and the gripping elements 38 of the gripping chain 36 engage the tubing 20 along substantially the entire length of the beam 44.

The outer surface of the chain 40 is in engagement with the inner surface of the chain 36 and is free wheeling about its sprockets 42. It is understood that a motor (not shown) is provided to drive at least one of the sprockets 37, and therefore the chain 36. The engagement between the chains 36 and 40 is such that the chain 36 drives the chain 40 which functions to support the chain 36.

Since the carriage 30*b* is identical to the carriage 30*a* the above components of the carriage 30*a* will be referred to by the same reference numerals in connection with the carriage 30*b*.

During the general operation, and referring to FIGS. 1 and 2, the tubing 20 is unspooled from the spool 18 and passes through the rollers 24 where it is straightened before it enters the injector 10. The cylinders 32*a* and 32*b* are normally in their extended positions and are actuated via the above-mentioned hydraulic circuit to force them to their retracted position and therefore drive the carriages 30*a* and 30*b* towards each other until the gripping elements 38 on the gripping chain 36 engage the tubing 20 at a predetermined loading. The above-mentioned motors are then activated to drive the sprocket 37 and the gripping chain 36, which, in turn drives the roller chain 40. It is understood that the carriage 30*b* functions in the same manner as the carriage 30*a* so that the gripping chain 36 on the carriage 30*b* engages the tubing 20 from a diametrically opposite direction with a predetermined load, or force. As a result, the tubing 20 is driven into the well 12.

Figure 3:
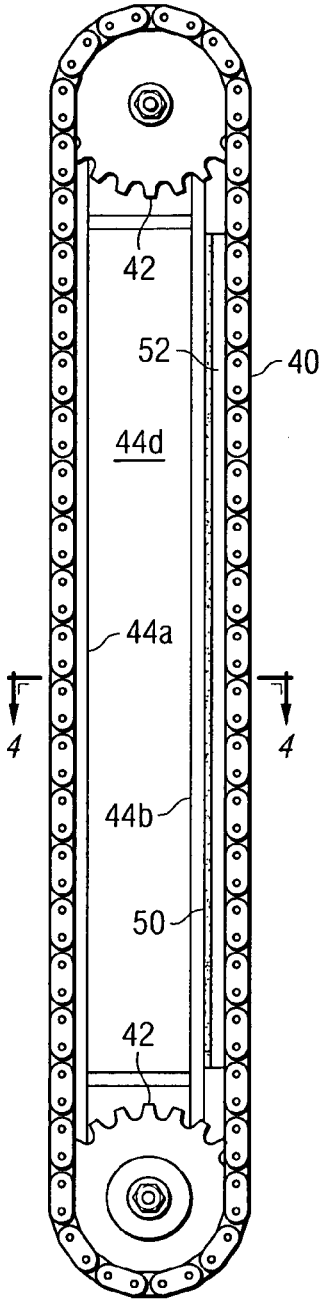
FIG. 3 is an enlarged front elevational view depicting a portion of one of the carriages of FIG. 2.
Figure 4:
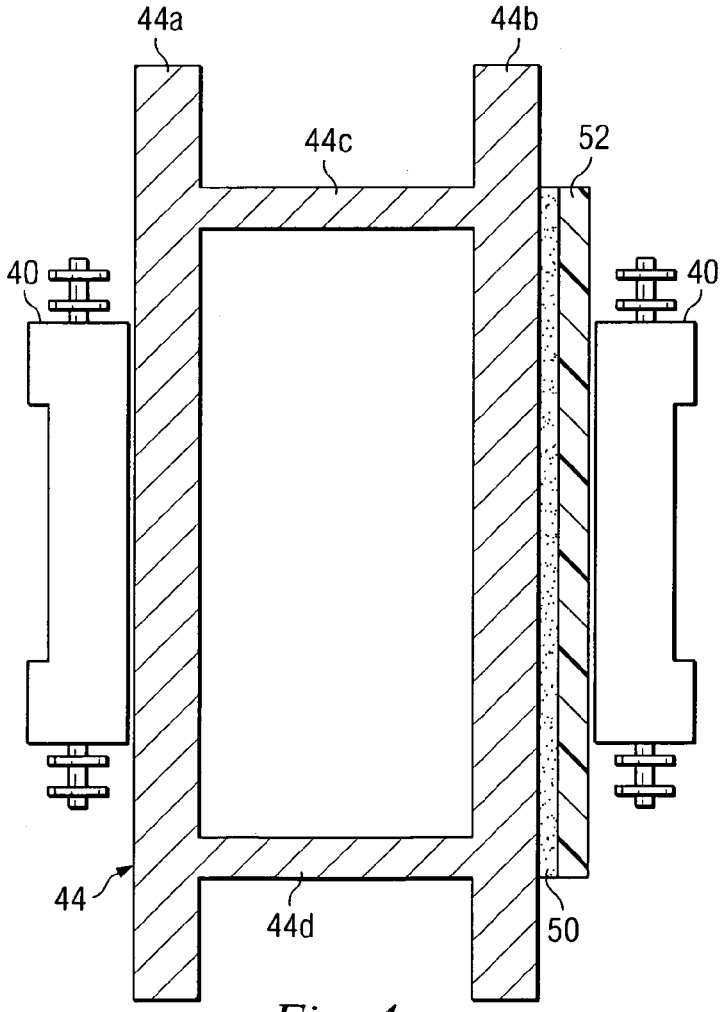
FIG. 4 is a cross-sectional view, taken along the line 4—4 of FIG. 3
Figure 5:
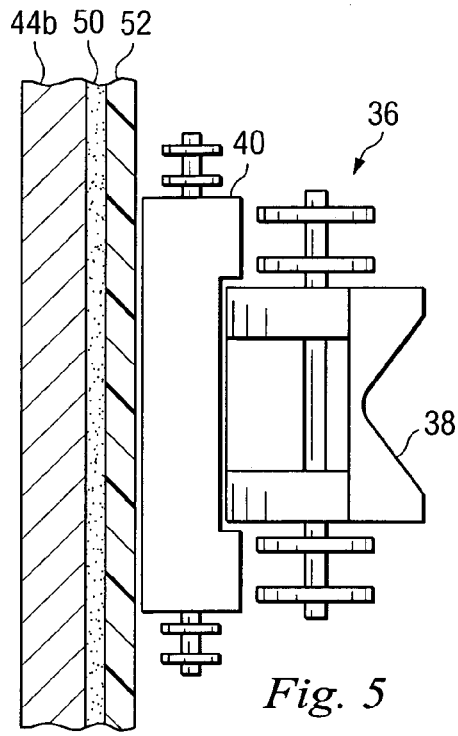
FIG. 5 is a cross-sectional view similar to that of FIG. 4, but depicting additional structure.

The beam 44 associated with the carriage 30*a* is shown in detail in FIGS. 3–5, and includes a pair of spaced, parallel plates 44*a* and 44*b* connected by two spaced, parallel webs 44*c* and 44*d* that extend perpendicular to the plates 44*a* and 44*b* and are connected, at their respective ends, to the corresponding inner surfaces of the plates in any known manner. The beam 44 extends for a length that is substantially the same as the distance between the sprockets 42 for the roller chain 40 and is positioned so that the beam plate 44*b* faces the carriage 30*b*.

As better shown in FIGS. 4 and 5, an elastomer plate 50 extends along the outer surface of the beam plate 44*b* for the length of the beam 44. The plate 50 is sandwiched between the beam plate 44*b* and a rigid support plate 52 having an outer surface that is engaged by the corresponding inner surface of the chain 40. The plates 50 and 52 can be fastened to the beam plate 44*b* in any conventional manner such as by shoulder bolts, or the like (not shown), preferably near the respective ends of the plates, with the fastening being such that the plates can deflect in the radial direction in a manner to be described. It is noted that FIG. 5 depicts a portion of the arrangement of FIG. 4 in addition to the gripping chain 36 and the gripping elements 38, with the latter chain extending around, and in engagement with, the chain 40.

As shown in FIG. 2, the carriage 30*b*, including its beam 44, is identical to the carriage 30*b* and is positioned with the inner portion of its gripping chain 36 facing the inner portion of the gripping chain 36 of the carriage 30*a*.

Figure 6:
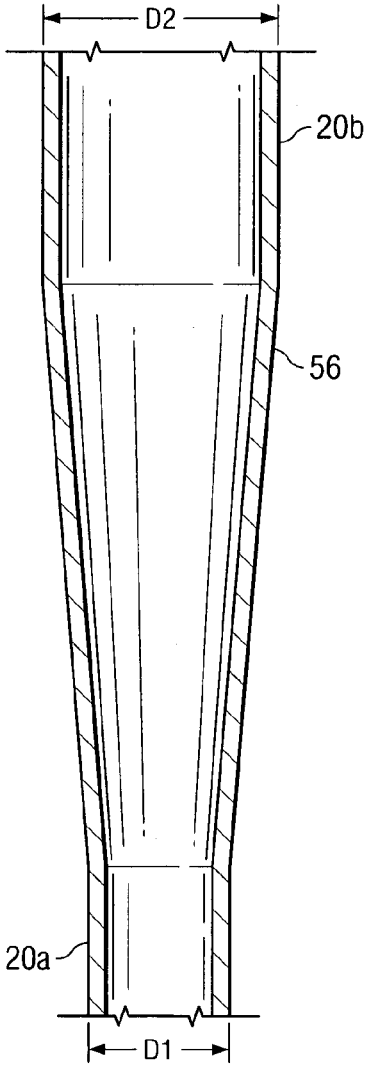
FIG. 6 is an vertical cross-sectional view of a tapered connector for the coiled tubing of FIG. 1.

Although the tubing 20 is depicted in FIGS. 1 and 2 as having a constant diameter, it is understood that the diameter of the tubing can vary along its length. For example, and referring to FIG. 6, a section 20*a* of the tubing 20 has a relatively small diameter D1 and another section 20*b* of the tubing 20 has a relatively large diameter D2. In order for the injector 10 to accommodate this diameter variance, a frustoconical connector 56 is fastened between the sections 20*a* and 20*b*, with the smaller diameter of the connector 56 corresponding to, and being connected to, the relatively small-diameter tubing section 20*a*, and the larger diameter of the connector corresponding to, and being connected to, the relatively large diameter tubing section 20*b*. These connections can be provided in any conventional manner, such as by providing external threaded nipples (not shown) on the respective ends of the connector 56 and threading the nipples into an internal threaded end portion of each of the sections 20*a* and 20*b*. As a result, the diameter of the tubing 20 gradually increases as the sections 20*a* and 20*b* pass through the injector 10.

In operation, the tubing 20, including one or more tubing sections 20*a* and 20*b* joined by a connector 56, is unspooled through a pathway defined by the rollers 24 and is straightened as it passes through the rollers and enters the injector 10. In this context, it is understood that the connector 56 and the relatively large-diameter tubing section 20*b* follow a relatively small section 20*a* as the tubing is unspooled and that the rollers 24 are adapted to pivot, retract, or the like, in a conventional manner to accommodate the connector 56 and the relatively large section 20*b*.

The cylinders 32*a* and 32*b* (as well as the two cylinders located on the back sides of the carriages 30*a* and 30*b*) are actuated via the above-mentioned hydraulic circuit to draw the carriages 30*a* and 30*b* towards each other in the manner described above until the gripper elements 38 on the gripping chains 36 engage the tubing 20 at a predetermined loading. The above-mentioned motors are then activated to drive the sprockets 37 and the gripping chain 36 of each carriage 30*a* and 30*b*, thereby gripping and lowering the tubing 20 into the well 12. Each gripping chain 36 also drives its corresponding roller chain 40 about the sprockets 42, with the roller chains providing support for their respective gripping chains.

During the passage of the tubing 20 through the injector 10 in the above manner, when a connector 56 enters the region of the injector 10 between the gripping chains 36 of the carriages 30*a* and 30*b*, the variable increasing diameter of the connector 56 creates a radially directed force that gradually increases along the length of the tubing. This force is applied directly to the chains 36 and 40 and deflects the chains radially outwardly causing a corresponding deflection of the plates 52 against their corresponding elastomer plates 50. As a result, the plates 50 are compressed against their corresponding beam plates 44*b* to accommodate this increase in diameter of the tubing 20.

Figure 7:
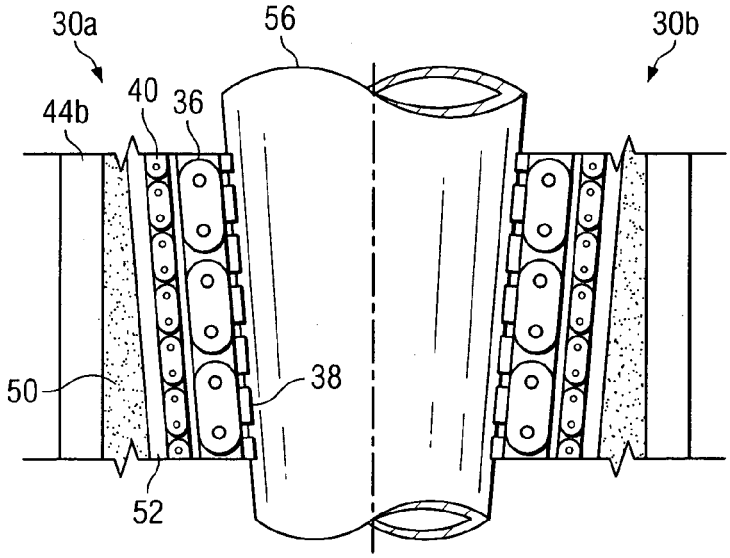
FIG. 7 is an enlarged, partial, elevational view depicting the tapered connector of FIG. 6 disposed between the carriages of FIG. 2 during an injection operation.

Each elastomer plate 50 will continue to compress further as the diameter of the connector 56 gradually increases as it passes through the path defined between the carriages 30*a* and 30*b*. Thus compression of the plates 50 will increase along their respective lengths so that the respective inner surfaces of the plates will take a tapered shape corresponding to the shape of the outer surface of the connector, as shown in FIG. 7.

Since the lengths of the plates 50 and 52 extend for substantially the length of the carriages 30*a* and 30*b*, a substantial number of gripper elements 38 of each of the chains 36 will contact the connector 56 during this gradual diameter increase of the tubing 20. Therefore, a uniform force distribution will be maintained along the length of the connector 56 which prevents the creation of isolated high stress areas.

It is understood that the above technique is the same when the tubing 20 is withdrawn from the well 12 and spooled back on the spool 18, with the direction of movement being opposite that discussed above.

It is understood that variations may be made in the foregoing without departing from the scope of the invention. For example, the invention may be used without the connector 56, such as with a spool of coiled tubing having a gradually increasing diameter along its entire length or with a spool of coiled tubing having a substantially constant diameter. Also, the plates 50 and/or 52 can be fastened to the beam plate 44*b* via fasteners other than shoulder bolts, such as with studs rigidly connected to and extending from the beam plate 44*b*. Further, the quantity of cylinders 32*a* and 32*b* may vary as long as an evenly distributed load is applied to the tubing 20 via the gripper elements 38. Moreover, any type of hydraulic circuit may be utilized to extend and retract the cylinders.

Any foregoing spatial references, such as "upper," "between," "front," "right side," "side," "above," etc., are for the purpose of illustration only and do not limit the specific spatial orientation of the structure described above.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. An apparatus for moving a tubing along a path, comprising:

an outer chain adapted to engage the tubing, wherein the outer chain is adapted to be driven to advance the tubing;

an inner chain engaged with the outer chain so that the inner chain is adapted to be driven by the outer chain and move with the outer chain generally along at least a portion of the path in response to the outer chain being driven, wherein the chains are adapted to be deflected radially in response to an increase in the diameter of the tubing; and a compression plate disposed adjacent the inner chain and adapted to be compressed in response to the deflection of the chains to accommodate the increase in tubing diameter.

2. The apparatus of claim 1 further comprising a rigid plate extending between the inner chain and the compression plate and adapted to be deflected radially in response to the deflection of the chain and forced against the compression plate to compress it.

3. The apparatus of claim 1 further comprising a beam for supporting the chains and having a surface against which the compression plate is compressed.

4. The apparatus of claim 1 wherein the tubing includes an adapter extending between tubing sections of varying diameter and wherein the compression of the plate causes the plate to take a shape corresponding to the shape of the adapter.

5. The apparatus of claim 4 wherein the diameter of the adapter, and therefore the corresponding shape of the plate, varies uniformly along its length.

6. An apparatus for moving a tubing along a path, comprising:

a chain adapted to engage the tubing and advance the tubing, wherein the chain is adapted to be deflected radially in response to a gradual increase in the diameter of the tubing;

a rigid plate positioned so that the rigid plate is adapted to be deflected radially in response to the deflection of the chain, wherein the rigid plate extends generally along at least a portion of the path and is sized to accommodate the gradual increase in diameter; and a compression plate disposed adjacent the rigid plate and adapted to be compressed in response to the deflection of the rigid plate to accommodate the gradual increase in diameter.

7. The apparatus of claim 6 further comprising a beam for supporting the chain and having a surface against which the compression plate is compressed.

8. The apparatus of claim 6 wherein the tubing includes an adapter extending between tubing sections of varying diameter and wherein the compression of the compression plate causes the compression plate to take a shape corresponding to the shape of the adapter.

9. The apparatus of claim 8 wherein the diameter of the adapter, and therefore the corresponding shape of the compression plate, varies uniformly along its length.

10. A method for moving a tubing along a path, comprising:

engaging the tubing with an outer chain;

driving the outer chain to advance the tubing;

supporting the outer chain with an inner chain that is driven by the outer chain and moves with the outer chain generally along at least a portion of the path in response to driving the outer chain to advance the tubing, wherein the chains are adapted to be deflected radially in response to an increase in the diameter of the tubing; and compressing a plate in response to the deflection of the chains to accommodate the variation in tubing diameter.

11. The method of claim 10 further comprising providing a rigid plate between the inner chain and the compressed plate so that the rigid plate is deflected radially in response to the deflection of the chain and forced against the compressed plate to compress it.

12. The method of claim 10 further comprising providing a beam for supporting the chains and having a surface against which the plate is compressed.

13. The method of claim 10 wherein the tubing includes an adapter extending between tubing sections of varying diameter and wherein the step of compressing causes the plate to take a shape corresponding to the shape of the adapter.

14. The method of claim 13 wherein the compression of the plate varies uniformly along its length.

15. A method for moving a tubing along a path, comprising:

engaging the tubing with a chain;

driving the chain to advance the tubing so that the chain deflects radially in response to a gradual increase in the diameter of the tubing;

providing a rigid plate so that the rigid plate is deflected radially in response to the deflection of the chain, wherein the rigid plate extends generally along at least a portion of the path and is sized to accommodate the gradual increase in diameter; and compressing another plate in response to the deflection of the rigid plate to accommodate the gradual increase in diameter.

16. The method of claim 15 further comprising providing a beam for supporting the chain and having a surface against which the other plate is compressed.

17. The method of claim 15 wherein the tubing includes an adapter extending between tubing sections of varying diameter and wherein the step of compressing causes the other plate to take a shape corresponding to the shape of the adapter.

18. The method of claim 17 wherein the shape of the other plate varies uniformly along its length.

19. An apparatus for moving a tubing along a path, comprising:

a beam comprising a beam plate;

a rigid plate coupled to the beam plate;

a compression plate sandwiched between the beam plate and the rigid plate;

an inner chain disposed around the beam, at least a portion of the inner chain being adjacent the rigid plate; and an outer chain engaged with the inner chain and disposed around the beam, the outer chain being adapted to engage the tubing;

wherein the outer chain is adapted to be driven to advance the tubing;

wherein the inner chain is adapted to be driven by the outer chain so that the inner chain moves with the outer chain generally along at least a portion of the path in response to the outer chain being driven;

wherein the chains are adapted to be deflected radially in response to a gradual increase in the diameter of the tubing;

wherein the rigid plate is adapted to be deflected radially in response to the deflection of the chains to accommodate the gradual increase in the diameter of the tubing; and wherein the compression plate is adapted to be compressed against the beam plate in response to the deflection of the rigid plate to accommodate the gradual increase in the diameter of the tubing.

* * * * *